US011215020B2

(12) United States Patent
Watkins et al.

(10) Patent No.: US 11,215,020 B2
(45) Date of Patent: Jan. 4, 2022

(54) DART WITH CHANGEABLE EXTERIOR PROFILE

(71) Applicant: ADVANCED UPSTREAM LTD., Calgary (CA)

(72) Inventors: Tom Watkins, Calgary (CA); Jeyhun Najafov, Calgary (CA)

(73) Assignee: Advanced Upstream Ltd., Calgary (CA)

( * ) Notice: Subject to any disclaimer, the term of this patent is extended or adjusted under 35 U.S.C. 154(b) by 0 days.

(21) Appl. No.: 16/796,713

(22) Filed: Feb. 20, 2020

(65) Prior Publication Data

US 2020/0270960 A1 Aug. 27, 2020

Related U.S. Application Data

(60) Provisional application No. 62/808,761, filed on Feb. 21, 2019.

(51) Int. Cl.

| | |
|---|---|
| ***E21B 23/04*** | (2006.01) |
| ***E21B 34/14*** | (2006.01) |
| ***E21B 23/00*** | (2006.01) |
| ***E21B 34/10*** | (2006.01) |
| *E21B 43/14* | (2006.01) |

(52) U.S. Cl.
CPC ..... *E21B 23/00* (2013.01); *E21B 23/0413* (2020.05); *E21B 34/10* (2013.01); *E21B 43/14* (2013.01); *E21B 2200/06* (2020.05)

(58) Field of Classification Search
CPC ..... E21B 23/0413; E21B 34/142; E21B 34/14
See application file for complete search history.

(56) References Cited

U.S. PATENT DOCUMENTS

| | | | |
|---|---|---|---|
| 7,520,336 | B2 | 4/2009 | Mondelli et al. |
| 7,909,108 | B2 | 3/2011 | Swor et al. |
| 9,650,851 | B2 | 5/2017 | Whitsitt et al. |
| 9,739,117 | B2 | 8/2017 | Campbell et al. |
| 9,835,004 | B2 | 12/2017 | Keerthivasan et al. |
| 9,938,788 | B2 | 4/2018 | Barbato |
| 10,294,748 | B2 | 5/2019 | Barbato et al. |
| 2012/0085538 | A1* | 4/2012 | Guerrero ..... E21B 43/14 166/284 |

(Continued)

FOREIGN PATENT DOCUMENTS

| | | |
|---|---|---|
| CA | 2986346 A1 | 1/2018 |
| CA | 3037373 A1 | 4/2018 |

*Primary Examiner* — Cathleen R Hutchins
(74) *Attorney, Agent, or Firm* — McCarthy Tétrault LLP

(57) ABSTRACT

A dart for effecting wellbore operations has an inactivated position and an activated position wherein the exterior profile of the dart is changed when the dart is activated. The change in profile may be achieved by moving (for example, rotating) a portion of the dart relative to the remaining portion. When inactivated, the exterior profile allows the dart to pass freely through a valve. When activated, the dart cannot pass through the valve because the changed exterior profile is caught by the interior profile of the valve. Once caught, the dart creates a seal to open the valve when fluid pressure above the seal is increased. The dart can thus be used in multiple stage applications with valves having seats of the same size so that the dart can be selectively activated to engage a desired valve seat.

22 Claims, 6 Drawing Sheets

(56) References Cited

U.S. PATENT DOCUMENTS

| | | | | |
|---|---|---|---|---|
| 2013/0175033 | A1* | 7/2013 | Baihly | E21B 34/14 166/284 |
| 2015/0218904 | A1* | 8/2015 | Chauffe | E21B 33/128 166/250.01 |
| 2015/0226035 | A1* | 8/2015 | Jani | E21B 34/16 166/308.1 |
| 2018/0328144 | A1 | 11/2018 | Arabsky et al. | |

* cited by examiner

DART WITH CHANGEABLE EXTERIOR PROFILE

CROSS-REFERENCE TO RELATED APPLICATIONS

This application claims the benefit of U.S. Provisional Application No. 62/808,761, filed Feb. 21, 2019, the content of which is hereby incorporated by reference in its entirety.

FIELD

The invention relates to a dart that can be selectively activated for performing downhole operations, and in particular to a dart having a changeable exterior profile for effecting downhole operations and methods relating thereto.

BACKGROUND

Recently wellbore treatment apparatus have been developed that include a wellbore treatment string for staged well treatment. The wellbore treatment string is useful to create a plurality of isolated zones within a well and includes an openable port system that allows selected access to each such isolated zone. The treatment string includes a tubular string carrying a plurality of external annular packers that can be set in the hole to create isolated zones therebetween in the annulus between the tubing string and the wellbore wall, be it cased or open hole. Openable ports, passing through the tubing string wall, are positioned between the packers and provide communication between the tubing string inner bore and the isolated zones. The ports are selectively openable and include a valve (which may comprise, for example, a sleeve) with a sealable seat formed in the inner diameter of the valve. By launching a plug, such as a ball, the plug can seal against the seat of a port's valve and pressure can be increased behind the plug to slide the valve open to gain access to an isolated zone through the open port. The seat in each valve can be formed to accept a plug of a selected diameter but to allow plugs of smaller diameters to pass. As such, a port can be selectively opened by launching a particular sized plug, which is selected to seal against the seat of that port's valve.

Unfortunately, however, such a wellbore treatment system may tend to be limited in the number of zones that may be accessed. In particular, limitations with respect to the inner diameter of wellbore tubulars, often due to the inner diameter of the well itself, restrict the number of different sized seats that can be installed in any one string. For example, if the well diameter dictates that the largest valve seat in a well can at most accept a 3¾" plug, then the well treatment string will generally be limited to approximately eleven valves and, therefore, treatment can only be effected in eleven stages.

Prior art solutions to maintain the full wellbore diameter and yet provide a method of selectively engaging a desired valve have involved using a plurality of darts, each having a unique profile machined circumferentially on its exterior to receivingly latch collets or fingers in a specific valve in the tubing string to create a fluid seal and then increasing fluid pressure above the valve to shift the valve open. However, drilling fluids and debris in the wellbore can become lodged in the dart's profile, thus preventing the dart from properly latching to the desired valve. If the dart passes through the desired valve without latching, the dart can land at the distal end of the wellbore, thereby restricting flow at the toe of the well. Further, it is costly and time consuming to design and manufacture each dart differently to have a unique profile and each valve to have unique mating collets or fingers, which increases the overall cost of the wellbore operations.

The present disclosure thus aims to address the above-mentioned limitations.

SUMMARY

According to a broad aspect of the present disclosure, there is provided a method for performing a downhole operation, the method comprising: placing a dart in a downhole tubing string comprising one or more sleeves, the dart being in an inactivated position and comprising a first portion, a second portion, and an exterior profile formed by outer surfaces of the first portion and the second portion; and activating the dart to place the dart in the activated position, the activating comprises moving the first portion relative to the second portion to change the exterior profile, wherein the exterior profile in the inactivated position allows the dart to pass through the one or more sleeves and the exterior profile in the activated position allows the dart to be caught by any one of the one or more sleeves.

In some embodiments, moving comprises rotating the first portion relative to the second portion.

In some embodiments, the method comprises determining, by the dart, a location of the dart prior to activating the dart.

In some embodiments, the method comprises comparing the location of the dart with a target location and activating the dart when the location matches the target location.

In some embodiments, the method comprises, after activating the dart, landing the dart in one of the one or more sleeves.

In some embodiments, the exterior profile in the activated position comprises one or more leading edges and the method comprises engaging the one or more leading edges with a seat of one of the one or more sleeves after activating the dart.

In some embodiments, the method comprises, after landing the dart, increasing a fluid pressure above the dart and shifting the one of the one or more sleeves to open a port.

In some embodiments, moving the first portion relative to the second portion is performed by a solenoid in the dart.

In some embodiments, activating the dart is performed by a device via wireless communication.

According to another broad aspect of the present disclosure, there is provided a dart for downhole operations, the dart comprising: a first portion having a first outer surface; and a second portion having a second outer surface, the second portion being rotatable relative to the first portion; an inactivated position, wherein the dart has an initial exterior profile defined by the first and second outer surfaces; and an activated position, wherein the second portion is moved relative to the first portion, and the dart has an activated exterior profile defined by the first and second outer surfaces, wherein the activated exterior profile is different from the initial exterior profile.

In some embodiments, the dart comprises an effective outer diameter and wherein the effective outer diameter is the same in the activated position and in the inactivated position.

In some embodiments, the first outer surface has one or more lands and one or more grooves and the second outer surface has one or more lands and one or more grooves, and wherein in the inactivated position, the one or more lands of the first outer surface are aligned with the one or more lands of the second outer surface to form one or more extended lands, and the one or more grooves of the first outer surface are aligned with the one or more grooves of the second outer surface to form one or more extended grooves, and wherein in the activated position, the one or more lands of the first outer surface are misaligned with the one or more lands of the second outer surface to expose one or more leading edges.

In some embodiments, in the inactivated position, the dart is configured to pass through a sleeve having an interior profile, the initial exterior profile being matingly configured relative to the interior profile to allow the dart to pass through the sleeve in the inactivated position and the activated exterior profile being configured relative to the interior profile to cause the dart to be caught by the sleeve.

In some embodiments, the interior profile has one or more lands and one or more grooves, wherein each of the one or more extended lands is configured to fit through one of the one or more grooves of the interior profile, and wherein each of the one or more lands of the interior profile is configured to fit through one of the one or more extended grooves.

In some embodiments, each of the one or more lands of the sleeve has a leading shoulder, and wherein in the activated position, the one or more leading edges are configured to engage the leading shoulder.

In some embodiments, each of the one or more lands of the first outer surface has at one end tapered leading edges that terminate in a pointed tip.

In some embodiments, the dart comprises a shaft and wherein the first and second portions are mounted on the shaft, and one of the first and second portions is rotatably mounted on the shaft.

In some embodiments, the dart comprises a first spring and a stop pin, for maintaining the dart in the inactivated position.

In some embodiments, the dart comprises a solenoid for transitioning the dart from the inactivated position to the activated position; and a second spring for biasing the dart to the activated position.

In some embodiments, the dart comprises a tapered or frustoconcially-shaped nose at a leading end of the dart.

In some embodiments, the dart comprises a cup seal at a trailing end of the dart.

In some embodiments, at least part of the dart is made of dissolvable materials.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

FIGS. 3A to 3D may be collectively referred to herein as FIG. 3.

FIGS. 5A to 5D may be collectively referred to herein as FIG. 5.

DETAILED DESCRIPTION OF THE INVENTION

Figure 1:
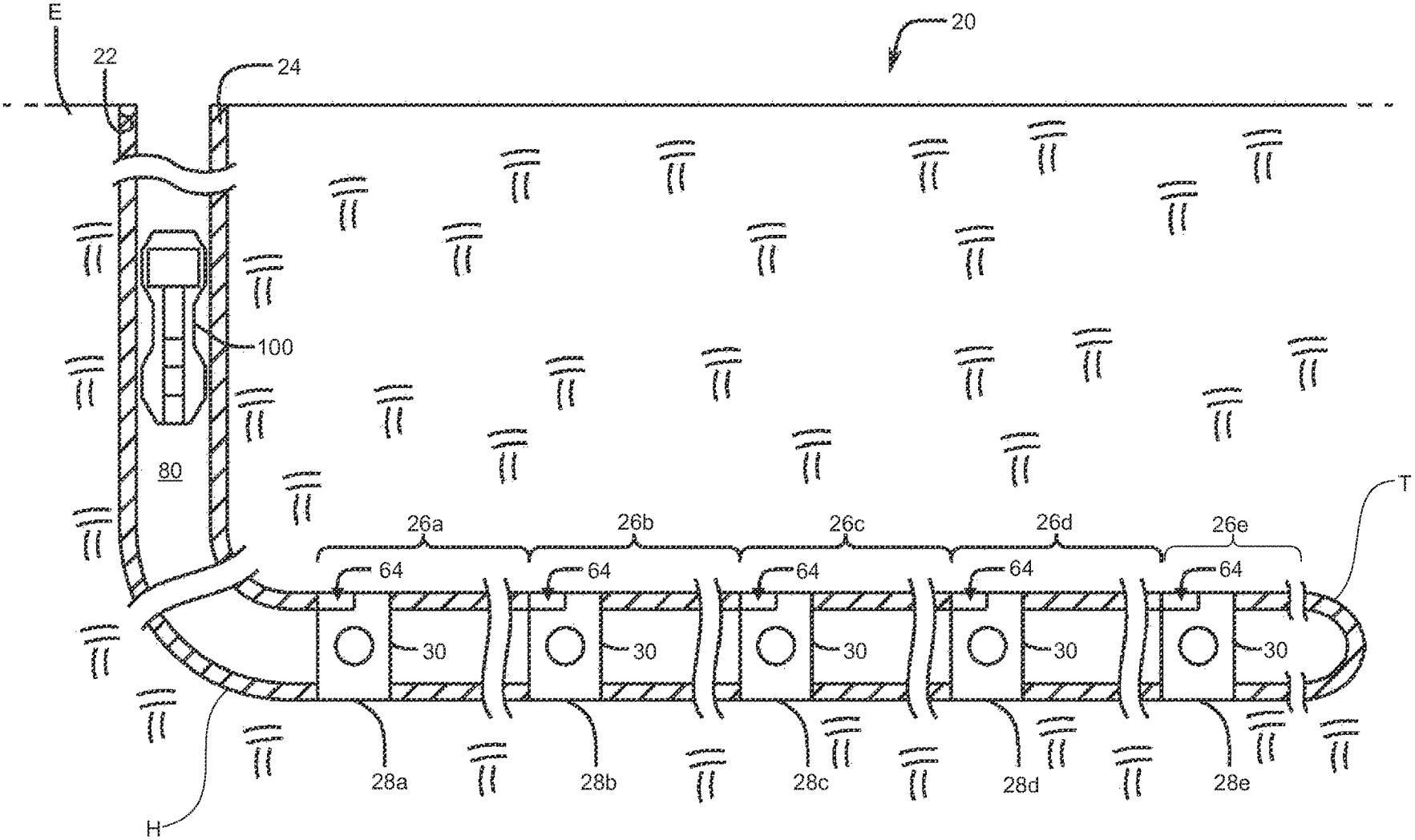
FIG. 1 is a schematic drawing of a multiple stage well according to one embodiment of the present disclosure.

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

In general, a dart is described herein for performing downhole operations, including the opening of a valve in a tubing string extending inside a wellbore. The dart has an inactivated position configured to pass through a valve without engaging the valve. The dart has an activated position configured to engage the valve to create a seal and then fluid pressure is increased above the seal to open the valve. The dart has a different exterior profile in the activated position than in the inactivated position and the change in exterior profile may be achieved by moving a portion of the dart relative to the remaining portion. The valve controls fluid flow through one or more ports. When in a closed position, the valve restricts fluid flow through the one or more ports. When in an open position, the valve allows fluid flow through the one or more ports. In some embodiments, when the valve is open, fluid communication is permitted between the inner bore of the tubing string and the wellbore via the one or more ports. The dart described herein can thus be used in, for example, multiple stage applications in which the dart is used in conjunction with valves having seats of the same size so that the dart can be selectively activated to engage a desired valve seat.

In some embodiments, to transition the dart from the inactivated position to the activated position, a portion of the dart's outer surface is moved (for example, rotated) to change the exterior profile of the dart in at least one axial location of the dart's outer surface. In some embodiments, the exterior profile is formed by a series of alternating lands and grooves on the outer surface of the dart. In some embodiments, in the inactivated position, the series of alternating lands and grooves in a first portion of the dart are aligned with the series of alternating lands and grooves in a second portion of the dart to define an initial exterior profile of the dart. The dart is placed in the activated position by rotating the second portion relative to the first portion to misalign the alternating lands and grooves of the second portion with those of the first portion, thereby changing the initial exterior profile of the dart to define an activated exterior profile. In some embodiments, the change in exterior profile does not change the effective outer diameter of the dart such that the effective outer diameter for the initial and activated exterior profiles is the same in both the inactivated and activated positions of the dart.

After activation, the dart's exterior profile is changed so that the dart can no longer pass through the valve. The dart, when activated, thus engages (or "lands in") the seat of the next valve in its path to thereby create a seal to open the valve when fluid pressure is increased above the seal. In some embodiments, the valve comprises a slidable sleeve and, in the activated position, the dart is configured to engage a seat of the sleeve to slide the sleeve axially from a first position to a second position, thereby transitioning the valve from a closed position to an open position. In some embodiments, the sleeve has an interior profile that is configured to allow the dart to pass therethrough when the dart is inactivated but catch the dart when the dart is activated. The interior profile may be formed by a series of alternating lands and the grooves on the inner surface of the sleeve, which may be circumferentially matingly arranged relative to the lands and grooves of the dart. In some embodiments, each land on the inner surface of the sleeve provides a leading shoulder and the leading shoulders, collectively, form a seat in the sleeve for catching the dart when the dart is activated.

In some embodiments, a portion of the dart is actuated by a solenoid to rotate a portion of the dart to change the dart's profile. In embodiments, the dart may be configured to self-determine its downhole position and self-activate when the dart reaches a target location. In other embodiments, the dart may be activated remotely by a device at surface via wireless communication. In some embodiments, the dart is employed in a method for engaging and actuating a downhole tool such as a valve. In the activated position, the dart can actuate the downhole tool, for example, by engaging the downhole tool and/or create a seal in the tubing string adjacent the downhole tool to block fluid flow therepast, including diversion of wellbore fluids.

The dart and related methods may be used for staged injection of treatment fluids wherein fluid is injected into one or more selected intervals of the wellbore, while other intervals are closed. In one embodiment, the dart is deployed to travel down the tubing string and is selectively activated to open a target port such that treatment fluid can be passed through the port to treat the interval accessed through the port.

The systems and methods described herein may be used in various borehole conditions including open holes, cased holes, vertical holes, horizontal holes, straight holes or deviated holes.

Referring to FIG. 1, in accordance with some embodiments, a multiple stage well 20 includes a wellbore 22, which traverses one or more formations (hydrocarbon bearing formations, for example). In embodiments, the wellbore 22 may be lined, or supported, by a tubing string 24. The tubing string 24 may be cemented to the wellbore 22 (such wellbores typically are referred to as "cased hole" wellbores); or the tubing string 24 may be secured to the formation by packers (such wellbores typically are referred to as "open hole" wellbores). In general, the wellbore 22 extends through one or multiple zones, or stages. In a sample embodiment, as shown in FIG. 1, wellbore 22 has five stages 26*a*,26*b*,26*c*,26*d*,26*e*.

In some embodiments, the well 20 may contain multiple wellbores, each having a tubing string that is similar to the illustrated tubing string 24. Moreover, in some embodiments, the well 20 may be an injection well or a production well.

In general, the downhole operations may be multiple stage operations that may be sequentially performed in the stages 26*a*,26*b*,26*c*,26*d*,26*e* in a particular direction (for example, in a direction from the toe T of the wellbore 22 to the heel H of the wellbore 22) or may be performed in no particular direction or sequence, depending on the particular embodiment.

In the illustrated embodiment, the well 20 includes downhole tools 28*a*,28*b*,28*c*,28*d*,28*e* that are located in the respective stages 26*a*,26*b*,26*c*,26*d*,26*e*. Each tool 28*a*,28*b*,28*c*,28*d*,28*e* may be any of a variety of downhole tools, such as a valve (a circulation valve, a casing valve, a sleeve valve, and so forth), a seat assembly, a check valve, a plug assembly, and so forth, depending on the particular embodiment. Moreover, all the tools 28*a*,28*b*,28*c*,28*d*,28*e* may not necessarily be the same and the tools 28*a*,28*b*,28*c*,28*d*,28*e* may comprise a mixture of different tools (for example, a mixture of casing valves, plug assemblies, check valves, etc.).

Each tool 28*a*,28*b*,28*c*,28*d*,28*e* may be selectively actuated by a dart 100 deployed through the inner passageway 80 of the tubing string 24. In general, the dart has an inactivated position to permit the dart to pass relatively freely through the passageway 80 and through one or more tools 28*a*,28*b*,28*c*,28*d*,28*e*, and the dart has an activated position, in which the dart is transformed to allow it to land in, or, be "caught" by, a selected one of the tools 28*a*,28*b*,28*c*,28*d*, or 28*e* or otherwise secured at a selected downhole location, for example, for purposes of performing a particular downhole operation. For example, a given downhole tool 28*a*,28*b*,28*c*,28*d*, or 28*e* (the "target tool") may catch the dart for one or more of the following purposes: form a downhole obstruction to divert fluid (for example, in a fracturing or other stimulation operation); pressurize a given stage 26*a*,26*b*,26*c*,26*d*,26*e*; shift a sleeve of the target tool; actuate the target tool; and install a check valve (part of the dart) in the target tool.

In the illustrated embodiment shown in FIG. 1, a dart 100 is deployed from the Earth surface E into passageway 80 of tubing string 24 and propagates along passageway 80 until the dart 100 determines its impending arrival at the target tool, for example tool 28*d* (as further described hereinbelow), transforms from its initial inactivated position into the activated position (as further described hereinbelow), and engages the target tool 28*d*. In some embodiments, the dart 100 remains in the inactivated position to pass through tool(s) (e.g., 28*a*,28*b*,28*c*) uphole of the target tool 28*d*, and transforms into the activated position before reaching the target tool 28*d*. It is noted that the dart 100 may be deployed from a location other than the Earth surface E. For example, the dart 100 may be released by a downhole tool. As another example, the dart 100 may be run downhole on a conveyance mechanism and then released downhole to travel further downhole untethered.

In some embodiments, one or more of the tools, including the target tool 28*d*, comprise a respective shiftable sleeve 30 for controlling the flow of fluids through one or more ports 64 in the tool. In some embodiments, each sleeve 30 has an open position wherein fluid is permitted to flow through the one or more ports 64 and a closed position wherein fluid flow through the one or more ports 64 is substantially blocked. The dart 100 is configured to selectively open a desired sleeve 30 (i.e., the sleeve in the target tool), while passing through other sleeve(s) 30 uphole of the target tool without opening the other sleeve(s) 30.

One embodiment of dart 100 is shown in FIGS. 2 to 5. The dart 100 has a leading end 102 and a trailing end 104. The dart 100 comprises a body 112, which may be positioned at or near the leading end 102, as shown for example in the illustrated embodiment, or anywhere between the leading end 102 and the trailing end 104. The body 112 may be generally cylindrical in shape. On the outer surface of the body 112 are one or more lands 118. Each land 118 is a raised area on the outer surface of body 112, i.e. the land 118 extends radially outwardly. In some embodiments, the one or more lands 118 are circumferentially spaced apart. A depressed area on the outer surface of body 112 adjacent to each land 118 defines a groove 116. In some embodiments, the groove 116 is defined between adjacent lands 118. In some embodiments, the lands 118 extend axially along at least some length of body 112 to define axially extending grooves 116. In some embodiments, the lands 118 are positioned at about the same axial location on the outer surface of body 112. In some embodiments, the grooves 116 are machined into the outer surface of body 112 to form lands 118. In some embodiments, lands 118 and the corresponding grooves 116 are substantially evenly circumferentially spaced apart about the outer surface of the body 112. While the illustrated embodiment shows three lands 118 and three grooves 116 on body 112, the number of grooves 116 and lands 118 may vary in other embodiments.

In some embodiments, the end of each land 118 that is closer to the leading end 102 has tapered leading edges 138 that terminate in a pointed tip 140. An angle θ is defined between the leading edges 138 of the land 118 and the angle θ may range from 0° to about 45°.

The dart 100 comprises a head 114, which may be positioned at or near the trailing end 104 (as shown for example in FIG. 2) or anywhere between the leading end 102 and the trailing end 104. The head 114 may be generally cylindrical in shape. On the outer surface of the head 114 are one or more lands 128. Each land 128 is a raised area on the outer surface of head 114, i.e. the land 128 extends radially outwardly. In some embodiments, the one or more lands 128 are circumferentially spaced apart. A depressed area on the outer surface of head 114 adjacent to each land 128 defines a groove 126. In some embodiments, the groove 126 is defined between adjacent lands 128. In some embodiments, the lands 128 extend axially along at least some length of head 114 to define axially extending grooves 126. In some embodiments, the lands 128 are positioned at about the same axial location on the outer surface of head 114. In some embodiments, the grooves 126 are machined into the outer surface of head 114 to form lands 128. Lands 128 and the corresponding grooves 126 are substantially evenly circumferentially spaced apart about the outer surface of the head 114. While the illustrated embodiment shows three lands 128 and three grooves 126 on head 114, the number of grooves 126 and lands 128 may vary in other embodiments. In some embodiments, the number of grooves 126 and lands 128 on head 114 is the same as the number of grooves 116 and lands 118 on body 112, and the circumferential spacing of the lands 128 and grooves 126 substantially match the circumferential spacing of the lands 118 and grooves 116.

In some embodiments, body 112 and head 114 are mounted on a shaft 120 such that either the body or the head is stationary relative to the shaft and the other is rotatable relative to the shaft. In further embodiments, body 112 and head 114 are concentrically mounted on the shaft 120 such that body 112, head 114, and the shaft 120 are co-axial. In one embodiment, the body 112 is rotatably mounted on the shaft 120 such that the body 112 is rotatable about the shaft 120 relative to the head 114. In an alternative embodiment, the head 114 is rotatably mounted on the shaft 120 such that the head 114 is rotatable about the shaft 120 relative to the body 112. In whichever configuration, the head 114 is rotatable relative to the body 112, and vice versa.

Figure 2:
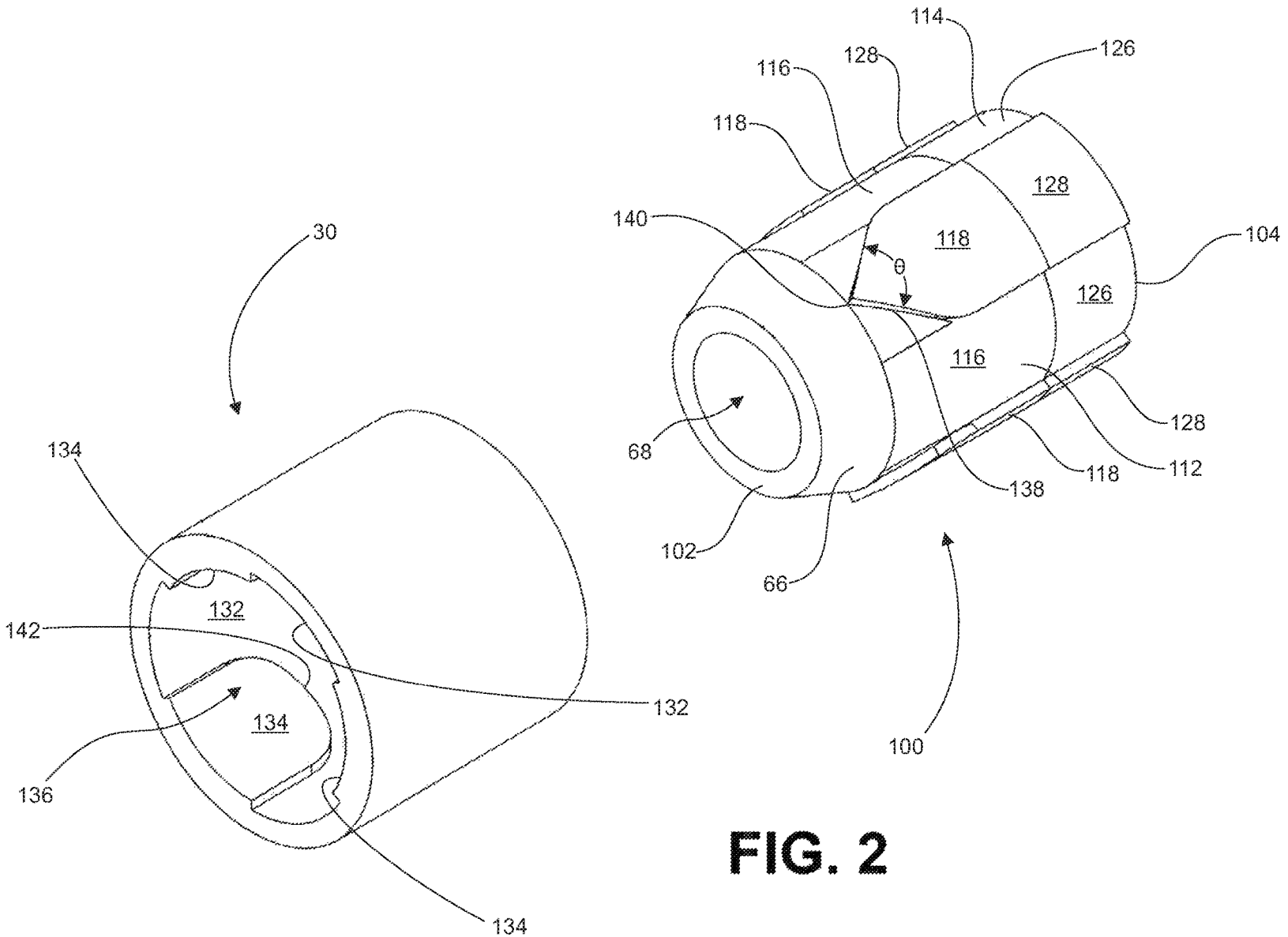
FIG. 2 is a perspective view of a dart along with a sleeve, according to one embodiment of the present disclosure; the dart is shown in an inactivated position in FIG. 2.

With reference to FIGS. 2 and 3, when the dart 100 is in the inactivated position, each groove 116 of the body 112 is substantially aligned with a groove 126 of the head 114 to provide an extended groove. The extended groove may extend axially from or near the leading end 102 to the trailing end 104 of the dart 100. In some embodiments, when a groove 116 is substantially aligned with a groove 126, the outer surfaces of the aligned grooves 116,126 are flush with one another at least at the interface between the grooves such that the extended groove is substantially smooth and/or even along its length. In some embodiments, when the grooves 116,126 are substantially aligned, each land 118 of the body 112 is also substantially aligned with a land 128 of the head 114 to provide an extended land. The extended land may extend axially from or near the leading end 102 to the trailing end 104 of the dart 100. In some embodiments, when a land 118 is substantially aligned with a land 128, the lengthwise sides of the aligned lands 118,128 are flush with one another at least at the interface between the lands so that the extended land has substantially smooth sides. In some embodiments, when a land 118 is substantially aligned with a land 128, the outer surfaces of the aligned lands 118,128 are flush with one another at least at the interface between the lands such that the outer surface of the extended land is substantially smooth and/or even along its length.

In some embodiments, the dart 100 comprises a first spring 122 and a stop pin 124 for aligning the lands 118,128 and grooves 116,126 to hold the dart 100 in the inactivated position. In some embodiments, the spring 122 and stop pin 124 are disposed inside body 112 and/or head 114. In some embodiments, the stop pin 124 has a first position wherein the spring 122 biases the dart towards the inactivated position. As a person skilled in the art can appreciate, other ways of maintaining the dart 100 in the inactivated position are possible.

In addition to the dart 100, FIG. 2 shows a sample sleeve 30 usable in a downhole tool. For simplicity, the sleeve 30 is shown in isolation from the tubing string and the downhole tool; however, as one skilled in the art can appreciate, in operation the sleeve 30 is an integral component of the downhole tool which is operably coupled to and is positioned somewhere along the tubing string. Sleeve 30 has an inner surface defining an axially extending inner bore 136. Inner bore 136 is sized to receive the dart 100. On the inner surface of sleeve 30 are one or more lands 134. In some embodiments, the one or more lands 134 are circumferentially spaced apart on the inner surface of sleeve 30. The land 134 is a raised area on the inner surface of sleeve 30, i.e. the land 134 extends radially inwardly. A depressed area on the inner surface of sleeve 30 adjacent to each land 134 defines a groove 132. In some embodiments, the groove 132 is defined between adjacent lands 134. Together, the grooves 132 and lands 134 define an interior profile of the sleeve 30. In some embodiments, the lands 134 extend axially along at least some length of sleeve 30 to define axially extending grooves 132. In some embodiments, the lands 134 are positioned at about the same axial location on the inner surface of sleeve 30. In some embodiments, the grooves 132 are machined into the inner surface of sleeve 30 to form lands 134. Lands 134 and the corresponding grooves 132 are substantially evenly circumferentially spaced apart about the inner surface of the sleeve 30. While the illustrated embodiment shows three lands 134 and three grooves 132 inside sleeve 30, the number of grooves 132 and lands 134 may vary in other embodiments. In some embodiments, the number of grooves 132 and lands 134 inside sleeve 30 is the same as the number of grooves 116 and lands 118 on body 112 (and/or the number of grooves 126 and lands 128 on head 114), and the circumferential spacing of the lands 134 and grooves 132 substantially match the circumferential spacing of the lands 118 and grooves 116 (and/or the lands 128 and grooves 126).

The dart 100 is configured, in its inactivated position as shown for example in FIGS. 2 and 3, to easily pass through the sleeve 30 via the inner bore 136. In some embodiments, the dart 100 has a tapered or frustoconically-shaped nose 66 at the leading end 102. The nose 66 helps the dart 100 enter the inner bore even if the dart 100 is not perfectly concentric with the sleeve as the dart approaches the inner bore 136. The nose 66 may also help the dart 100 center itself relative to the sleeve 30 as the dart enters the inner bore 136.

Figure 3B:
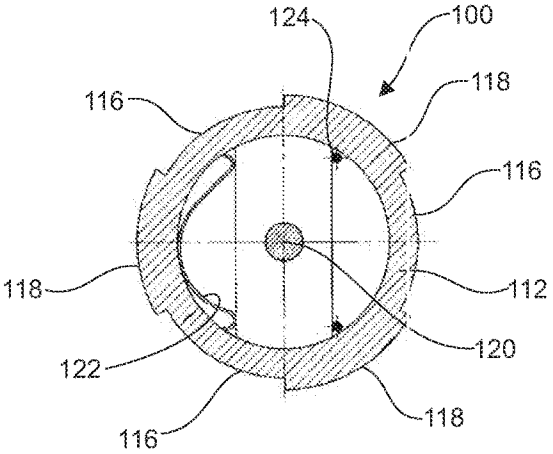
FIG. 3B is a cross-sectional view of the dart of FIG. 3A, taken along line B-B, showing the exterior profile of the dart at one axial location in the inactivated position.
Figure 3D:
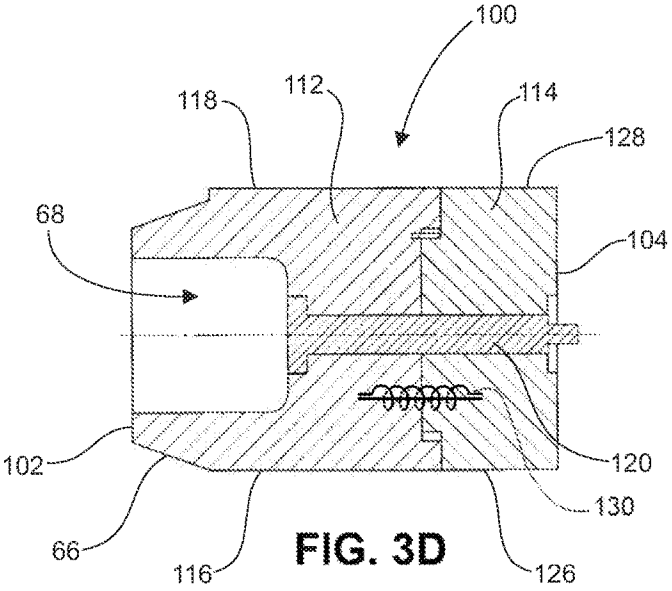
FIG. 3D is a cross-sectional view of the dart of FIG. 3C, taken along line A-A.
Figure 3A:
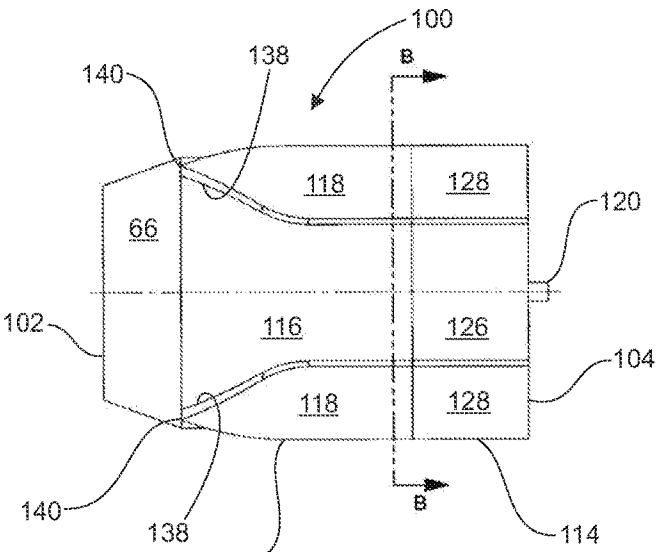
FIG. 3A is a side plan view of the dart of FIG. 2.
Figure 3C:
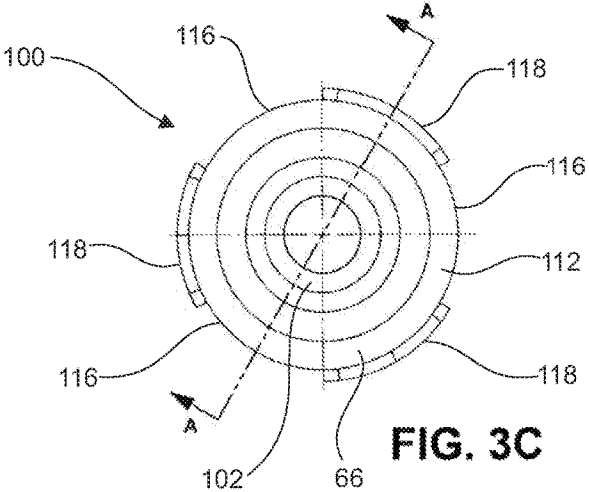
FIG. 3C is a front plan view of the dart of FIG. 2, showing the exterior profile of the dart in the inactivated position.
Figure 5B:
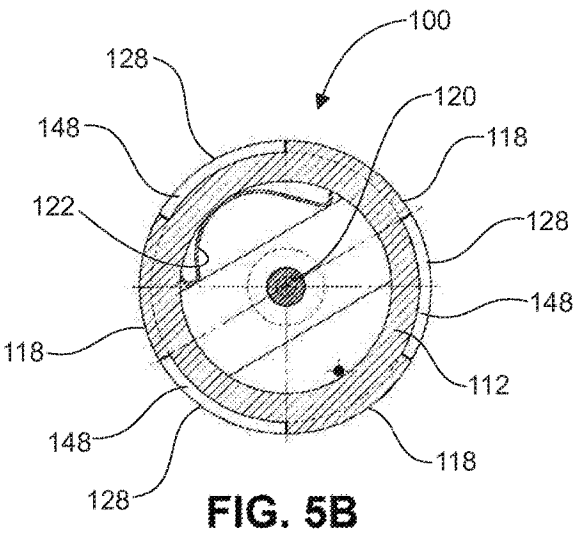
FIG. 5B is a cross-sectional view of the dart of FIG. 5A, taken along line D-D, showing the exterior profile of the dart at one axial location in the activated position.
Figure 5D:
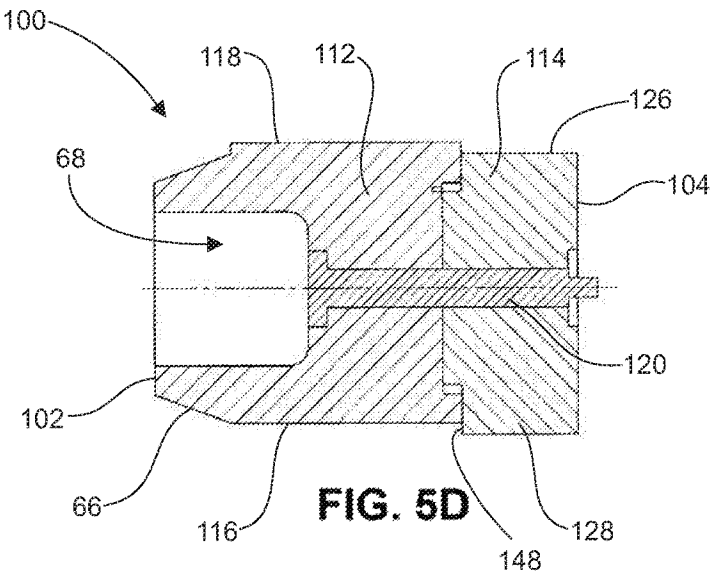
FIG. 5D is a cross-sectional view of the dart of FIG. 5C, taken along line C-C.
Figure 5A:
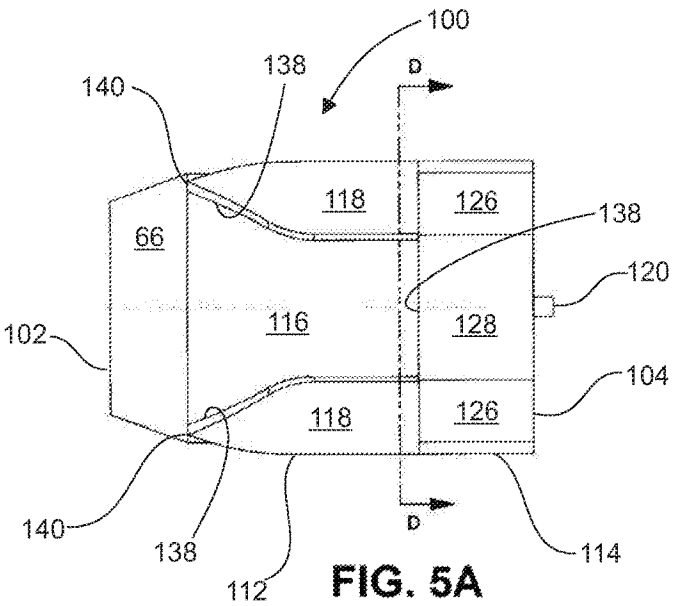
FIG. 5A is a side plan view of the dart of FIG. 4.
Figure 5C:
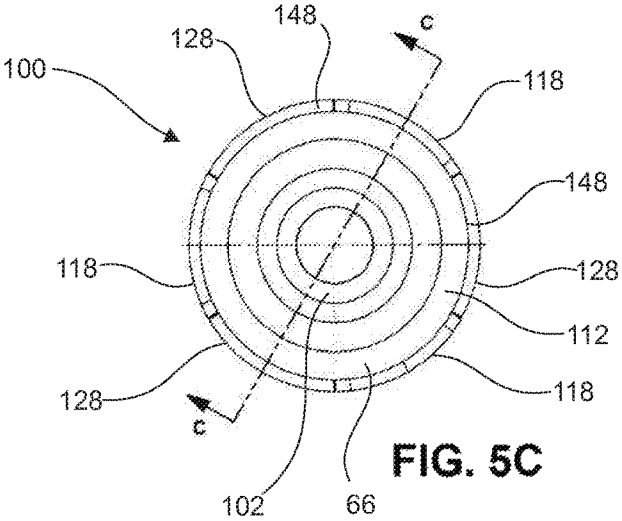
FIG. 5C is a front plan view of the dart of FIG. 4, showing the exterior profile of the dart in the activated position.

In some embodiments, as best shown in FIGS. 3D and 5D, the dart 100 may have an optional cavity 68 defined herein and cavity 68 is open at the leading end 102. With everything else being equal, the inclusion of cavity 68 reduces the weight of dart 100.

The extended lands formed by substantially aligned lands 118,128 are sized to easily fit through the grooves 132 inside sleeve 30 and the lands 134 are sized to easily fit through the extended grooves formed by substantially aligned grooves 116,126, such that the inactivated dart can pass freely through the sleeve 30 via the inner bore 136.

If the extended lands and the extended grooves of the dart 100 are aligned with the grooves 132 and lands 134, respectively, as the dart enters the sleeve 30, then the dart can pass through and exit the sleeve without any hinderance. To help the extended lands and extended grooves on dart 100 align with the grooves 132 and lands 134, respectively, as the dart travels through the inner bore 136, the lands 134 each have a respective leading shoulder 142 having rounded corners on both sides to provide a smooth transition between the leading shoulder 142 and the lengthwise sides of the land 134. The leading shoulder 142 is configured to engage the pointed tip 140 and one of the tapered leading edges 138 to help direct the extended land of the dart 100 into a groove 132 in the sleeve 30. For example, if the extended lands are not perfectly aligned with the grooves 132 as the dart 100 slides into the sleeve 30, each pointed tip 140 encounters one of the lands 134 somewhere along leading shoulder 142 and the curvature of the shoulder 142 causes the pointed tip 140, followed by one of the tapered leading edges 138 and the corresponding lengthwise side of the extended land, to slide towards one of the rounded corners and then down the corresponding side of the land 134, thereby rotating the dart to direct the extended land of the dart to be received in and slide through the groove 132 on either side of land 134. In this manner, all the extended lands of dart 100 can be substantially simultaneously directed into alignment with the grooves 132 as the dart travels inside the sleeve 30. Further, alignment of the extended lands of the dart with the grooves 132 also aligns the extended grooves of the dart with the lands 134 of the sleeve 30, thus allowing the dart to pass freely through the inner bore 136 without shifting the sleeve.

Figure 4:
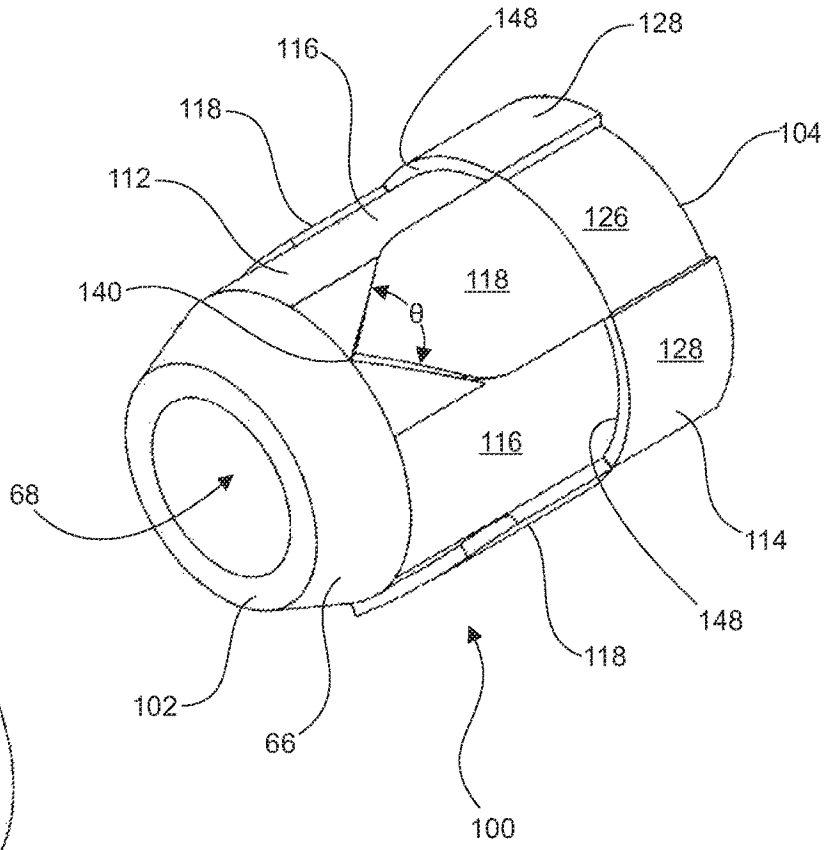
FIG. 4 is a perspective view of the dart and the sleeve in FIG. 2, but the dart is shown in an activated position in FIG. 4.
Figure 4:
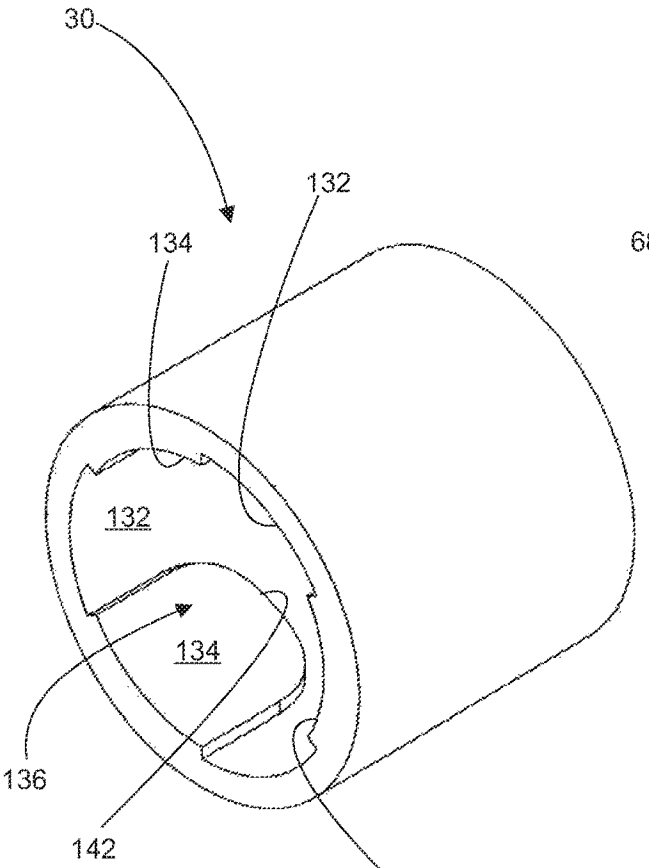

The dart 100 is configured, in its activated position as shown for example in FIGS. 4 and 5, to engage and be caught by the sleeve 30. In the inactivated position, the head 114 is rotated relative to the body 112 such that the lands 118 are misaligned with lands 128. Due to the misalignment, at least a portion of each land 128 overlaps circumferentially with one of the grooves 116, exposing a leading edge 148 of the land 128. Comparing FIG. 3 with FIG. 5, the activated exterior profile of the dart 100 in the activated position is different from the initial exterior profile in the inactivated position. However, in the illustrated embodiment, the change in profile of dart 100 does not affect the effective outer diameter of the dart.

In some embodiments, the head 114 or the body 112 may be rotated by a second spring (not shown) that biases the dart towards the activated position when the stop pin 124 is moved to a second position from the first position. In some embodiments, the dart 100 comprises a solenoid 130 (shown in FIG. 3D) for moving the stop pin 124 from the first position to the second position. In other embodiments, the stop pin 124 is moved from the first position to the second position by a motor drive, an explosive charge, or other methods known to those skilled in the art.

In the inactivated position, the dart 100 slides into the sleeve 30 and each pointed tip 140 encounters one of the lands 134 somewhere along leading shoulder 142 and the curvature of the shoulder 142 causes the pointed tip 140, followed by one of the tapered leading edges 138 and the corresponding lengthwise side of the land 118, to slide towards one of the rounded corners and then down the corresponding side of the land 134, thereby rotating the dart to direct land 118 of the dart to be received in the groove 132 on either side of land 134. With the lands 118 aligned with the grooves 132, the dart 100 can advance further into the sleeve 30 until the exposed leading edges 148 of lands 128 abut against leading shoulders 142 of lands 134 inside the sleeve. Once the leading edges 148 engage the leading shoulders 142, the dart 100 is stopped from advancing further into the sleeve 30. Together, the leading shoulders 142 form a seat inside sleeve 30 for catching the activated dart.

Figure 6A:
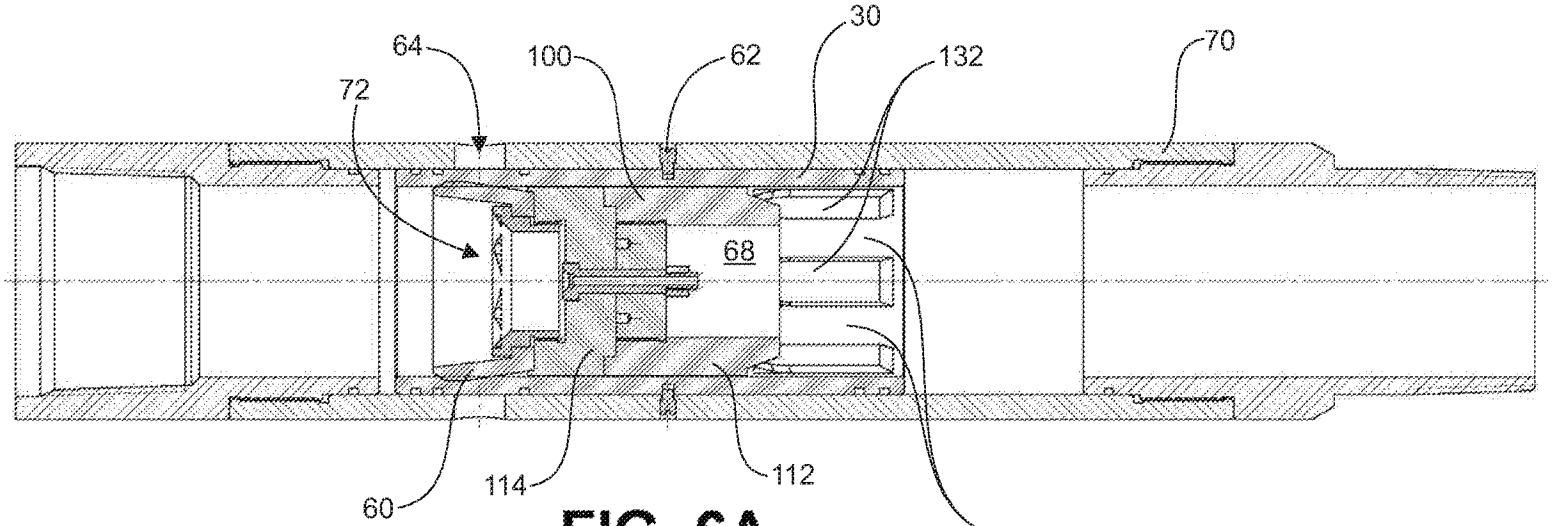
FIG. 6A is a cross-sectional view of the dart inside a sample downhole tool; the dart is shown in the inactivated position.
Figure 6B:
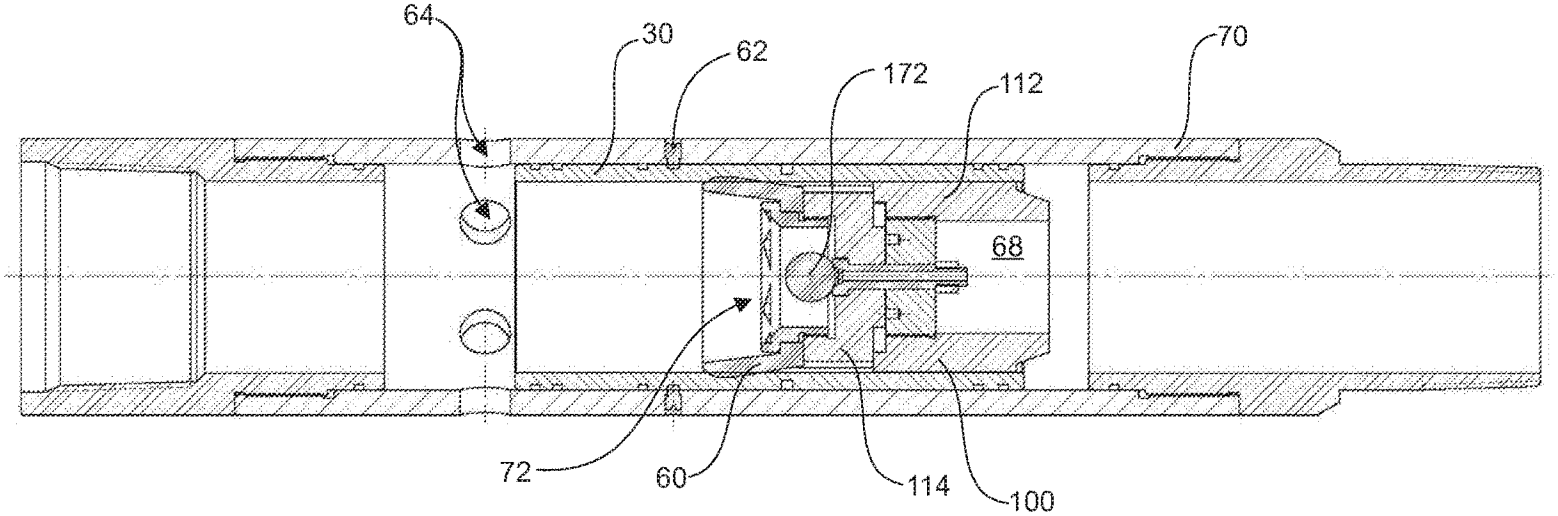
FIG. 6B is a cross-sectional view of the dart inside the downhole tool of FIG. 6A; the dart is shown in the activated position.

FIGS. 6A and 6B show the dart 100, in its inactivated position and activated position, respectively, traveling inside a downhole tool 70, which in the illustrated embodiment is a completion collar assembly. The downhole tool 70 has defined in its wall a plurality of ports 64 and the tool comprises an inner shiftable sleeve 30 for controlling fluid flow through the plurality of ports 64. When the sleeve 30 is closed, as shown in FIG. 6A, the body of the sleeve 30 blocks the ports 64 to restrict fluid flow through the ports. In some embodiments, tool 70 includes one or more shear pins 62 to help keep the sleeve 30 closed until the sleeve is engaged by an activated dart. When the sleeve 30 is open, as shown in FIG. 6B, the ports 64 are unblocked to allow fluid communication between the inner bore of tool 70 and the space outside the tool 70.

In the illustrated embodiment shown in FIG. 6A, the shaft 120 has an inner axial bore extending therethrough. In some embodiments, the inner bore of shaft 120 allows fluid communication through the dart, between the leading end 102 and the trailing end 104. In the illustrated embodiment, the dart 100 comprises a cup seal 60 attached to the trailing end 104. In some embodiments, the cup seal 60 provides a flexible fluid seal against the inner surface of the tool 70, including inner bore 136, as the dart moves inside the tool, which may allow the dart to be more easily pumped down the tubing string by uphole fluid pressure. In some embodiments, the cup seal 60 has an open cavity 72 defined therein that is in fluid communication with the cavity 68 at the leading portion of the dart via the inner bore of shaft 120. In some embodiments, the cup seal 60 is sized to be slightly larger than the inner bore of the sleeve 30 such that as the cup seal is squeezed into each sleeve (when the inactivated dart enters the sleeve) the fluid pressure above the dart increases and then immediately drops as soon as the dart, along with the cup seal, passes through and exits the sleeve. These increases and sudden decreases in fluid pressure above the dart can be monitored to help determine the real-time location of the dart within the tubing string.

In operation, when the dart 100 is first launched into the passageway of the tubing string 24, the dart is initially in the inactivated position wherein the dart has an initial exterior profile defined by one or more extended lands (formed by aligned lands 118,128) and one or more extended grooves (formed by aligned grooves 116,126). Once the dart is launched downhole, fluid is pumped from surface into the tubing string and the fluid pressure behind the dart pushes the dart down the passageway. As described above, each of the extended lands of the inactivated dart is sized to easily fit through a groove 132 of the sleeve 30. As the dart is in the inactivated position, the dart passes freely through the tool(s) 70 that the dart encounters in its path.

When desired, the dart is activated to engage the next tool in its path. For example, upon receipt of a signal, a solenoid in the dart is actuated to rotate a portion of the dart, thereby changing the initial exterior profile of the dart to the activated exterior profile and transforming the dart to its activated position. In some embodiments, as described above, the lands 118,128 are misaligned when the dart is activated to expose leading edges 148. After activation, the dart continues to travel downhole until the dart enters the sleeve 30 of the next tool and, as a result of its changed exterior profile, the dart is eventually caught by sleeve 30 when the exposed leading land faces 148 abut against the leading shoulders 142. In some embodiments, as shown in FIG. 6B, a ball 172 is launched downhole after the dart is caught by sleeve 30 and the ball 172 lands inside cavity 72 to substantially seal the inner bore of shaft 120, thereby restricting fluid communication between cavity 72 and the inner bore of shaft 120. As fluid continues to be pumped down the tubing string, along with the cup seal 60 and ball 172 restricting fluid communication through the dart, fluid pressure increases above the caught dart and the pressure differential across the dart exerts an axial force on the sleeve 30 in the downhole direction. When the axial force on the sleeve exceeds the threshold of the shear pins 62, the shear pins are broken and the sleeve 30 is then shifted open by the axial force to expose ports 64, thereby allowing fluid to flow through the ports.

In some embodiments, the ball 172 acts as a one-way valve to allow fluid in the tubing string to be circulated in the reverse (i.e., uphole) direction while blocking fluid flow downhole through the inner bore of the shaft 120. Reverse circulation may be useful for debris removal operations for cleaning the passageway and/or screens of the tubing string. When the flow in the tubing string is reversed, the ball 172 may flow back to surface with the reverse circulating fluid in the tubing string.

In some embodiments, at least a portion of the dart 100 is made of dissolvable materials so that part of the dart dissolves away after the dart completes the desired downhole operation (e.g. shifted a sleeve in a downhole tool), to allow fluid communication throughout the tubing string. In some embodiments, at least a portion of the dart is made of TervAlloy™ such as TervAlloy TAx-100E™ or another suitable material known to those skilled in the art. In other embodiments, the dart is milled out after the dart completes the desired downhole operation.

The above-described dart and methods may be useful for stimulation of a formation, using stimulation fluids, such as for example, acid, water, oil, $CO_2$ and/or nitrogen, with or without proppants.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. A method for performing a downhole operation, the method comprising:

placing a dart in a downhole tubing string comprising one or more sleeves, the dart being in an inactivated position and comprising a first portion, a second portion, and an exterior profile formed by outer surfaces of the first portion and the second portion; and activating the dart to place the dart in the activated position, the activating comprises moving the first portion relative to the second portion to change the exterior profile, without changing an effective outer diameter of the exterior profile, wherein the exterior profile in the inactivated position allows the dart to pass through the one or more sleeves and the exterior profile in the activated position allows the dart to be caught by any one of the one or more sleeves.

2. The method of claim 1 wherein moving comprises rotating the first portion relative to the second portion.

3. The method of claim 1 comprising determining, by the dart, a location of the dart prior to activating the dart.

4. The method of claim 3 comprising comparing the location of the dart with a target location and activating the dart when the location matches the target location.

5. The method of claim 1 comprising, after activating the dart, landing the dart in one of the one or more sleeves.

6. The method of claim 5 comprising, after landing the dart, increasing a fluid pressure above the dart and shifting the one of the one or more sleeves to open a port.

7. The method of claim 1 wherein moving the first portion relative to the second portion is performed by a solenoid in the dart.

8. The method of claim 1 wherein activating the dart is performed by a device via wireless communication.

9. The method of claim 1 wherein moving the first portion relative to the second portion to change the exterior profile exposes one or more leading edges of the second portion.

10. The method of claim 9 comprising engaging the one or more leading edges with a seat of one of the one or more sleeves after activating the dart.

11. A dart for downhole operations, the dart comprising:

a first portion having a first outer surface having a first outer diameter; and a second portion having a second outer surface having a second outer diameter, the second portion being rotatable relative to the first portion;

an inactivated position, wherein the dart has an initial exterior profile defined by the first and second outer surfaces; and an activated position, wherein the second portion is moved relative to the first portion, and the dart has an activated exterior profile defined by the first and second outer surfaces, wherein the activated exterior profile is different from the initial exterior profile, and the first and second outer diameters in the inactivated position are the same as the first and second outer diameters, respectively, in the activated position.

12. The dart of claim 11 wherein the first outer surface has one or more lands and one or more grooves and the second outer surface has one or more lands and one or more grooves, each of the one or more lands of the second outer surface has a respective second portion leading edge, and wherein in the inactivated position, the one or more lands of the first outer surface are aligned with the one or more lands of the second outer surface to form one or more extended lands, and the one or more grooves of the first outer surface are aligned with the one or more grooves of the second outer surface to form one or more extended grooves, and wherein in the activated position, the one or more lands of the first outer surface are misaligned with the one or more lands of the second outer surface to expose at least one of the respective second portion leading edges.

13. The dart of claim 12 wherein in the inactivated position, the dart is configured to pass through a sleeve having an interior profile, the initial exterior profile being matingly configured relative to the interior profile to allow the dart to pass through the sleeve in the inactivated position and the activated exterior profile being configured relative to the interior profile to cause the dart to be caught by the sleeve.

14. The dart of claim 13 wherein the interior profile has one or more lands and one or more grooves, wherein each of the one or more extended lands is configured to fit through one of the one or more grooves of the interior profile, and wherein each of the one or more lands of the interior profile is configured to fit through one of the one or more extended grooves.

15. The dart of claim 14 wherein each of the one or more lands of the sleeve has a respective leading shoulder, and wherein in the activated position, at least one of the respective second portion leading edges is configured to engage at least one of the respective leading shoulders.

16. The dart of claim 12 wherein each of the one or more lands of the first outer surface has at one end respective tapered leading edges that terminate in a pointed tip.

17. The dart of claim 11 comprising a shaft and wherein the first and second portions are mounted on the shaft, and one of the first and second portions is rotatably mounted on the shaft.

18. The dart of claim 11 comprising a spring and a stop pin, for maintaining the dart in the inactivated position.

19. The dart of claim 11 comprising a solenoid for transitioning the dart from the inactivated position to the activated position; and a spring for biasing the dart to the activated position.

20. The dart of claim 11 comprising a tapered or frustoconcially-shaped nose at a leading end of the dart.

21. The dart of claim 11 comprising a cup seal at a trailing end of the dart.

22. The dart of claim 11 wherein at least part of the dart is made of dissolvable materials.

* * * * *